United States Patent [19]

Onishi

[11] 4,231,275

[45] Nov. 4, 1980

[54] CUTTER FOR THIN BOARDS

[76] Inventor: Nobuo Onishi, 2-3, 3-chome, Tanaka, Minato-ku, Osaka, Japan

[21] Appl. No.: 30,878

[22] Filed: Apr. 17, 1979

[30] Foreign Application Priority Data

Oct. 19, 1978 [JP] Japan ..... 53-145582[U]

[51] Int. Cl.[3] ..... B26D 9/00; B26D 11/00

[52] U.S. Cl. ..... 83/862; 83/49; 83/52; 83/614; 83/622; 83/745; 83/882

[58] Field of Search ..... 83/862, 882, 865, 52, 83/49, 56, 745, 743, 614, 622

[56] References Cited

U.S. PATENT DOCUMENTS

| | | | |
|---|---|---|---|
| 611,238 | 9/1898 | Drinkaus | 83/862 |
| 1,838,011 | 12/1931 | Peter | 83/862 |
| 2,093,022 | 9/1937 | Olsen | 83/743 X |
| 3,196,917 | 7/1965 | Frank | 83/865 |
| 4,016,649 | 4/1977 | Kloster | 83/745 X |
| 4,176,572 | 12/1979 | Pennington | 83/862 |

*Primary Examiner*—Frank T. Yost

*Attorney, Agent, or Firm*—Wenderoth, Lind & Ponack

[57] ABSTRACT

A cutter for cutting thin boards, including a base provided with a plurality of guide grooves on one side in such a manner that they are arranged so as to form progressively larger angles with the under surface of the base. A cutting blade is mounted in each of these guide grooves in such a manner that all the cutting blades fall on the same plane with each other.

3 Claims, 6 Drawing Figures

CUTTER FOR THIN BOARDS

The present invention relates to a cutter for cutting thin boards.

Conventionally, there has always been a need for finishing the cut ends when a thin board such as a plywood board has been cut with a saw or an ordinary cutter, because these cutting tools have inevitably produced rugged cut ends. Especially an ordinary cutter requires a means by which the edge of the blade is to be guided during the cutting stroke. Furthermore, several cutting strokes are required for cutting off a piece.

It is an object of the present invention to eliminate the above-mentioned disadvantages by providing a cutter with which thin boards can be cut with accuracy and ease without resort to a guide apparatus.

With this object in view which will become apparent from the following detailed description, the present invention will be more clearly understood in connection with the accompanying drawings, in which.

Figure 1:
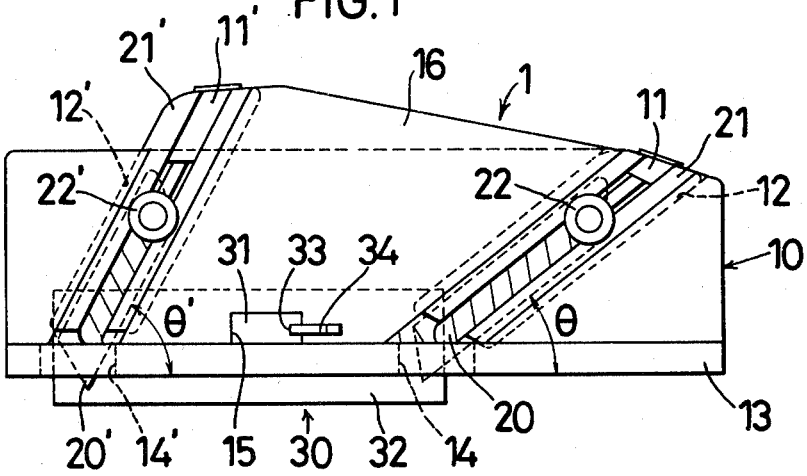
FIG. 1 is a front view of an embodiment of the present invention.
Figure 2:
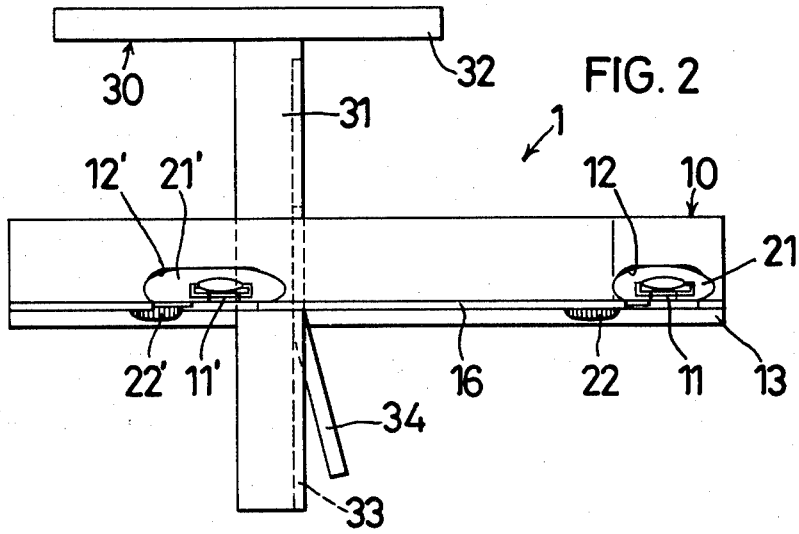
FIG. 2 is a plan view thereof.
Figure 3:
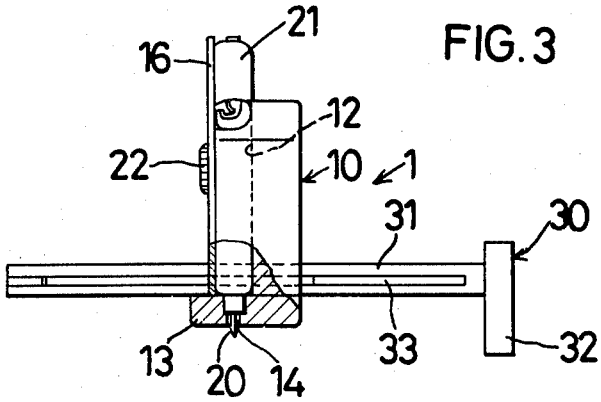
FIG. 3 is a partially cutaway side view thereof.

Referring to FIGS. 1 to 3, a cutter 1 according to this invention has a base 10 made of wood, hard synthetic resin, aluminum die cast or other material.

The base 10 is also formed on one side thereof with two grooves 12, 12' in which the blade mounting members 21, 21' are mounted and clamped in place by means of a backplate 16 and binding screws 22, 22'. The members 21, 21' are formed with guide grooves 11, 11' in which cutting blades 20, 20' are slidably mounted so as to be in alignment with each other.

The under surface of the base 10 is provided with a bottom plate 13, which is preferably made of wood or may be made of the same material as that of the base 10 in solid structure therewith. The edges of the cutting blades 20, 20' are projected downward from, and retracted in, slits 14, 14' provided in the bottom plate 13.

The guide grooves 11, 11' form different angles with the under surface of the bottom plate 13, so that the cutting blades 20, 20' may be allowed to impart a cutting action to a thin board at different angles. The first cut, which is made with the cutting blade 20 at a smaller angle $\theta$, is traced by the cutting blade 20' at a larger angle $\theta$, so that the severance may be effected by the latter. The smaller angle formed by the cutting blade 20 serves to minimize resistance to be undergone by the cutting blade 20, and prevent the cut end from becoming rugged.

A guide member 30 provided in the lower part of the base 10 comprises a slide bar 31, which is slidably inserted in a hole 15 provided crossways in the base 10, and a guide plate 32, which is provided at an end of the slide bar 31. The distance between the guide plate 32 and the cutting blades 20, 20' is adjusted to the breadth of the piece of a thin board to be cut off. To facilitate this adjustment, the slide bar 31 may be marked with graduations. When the adjustment has been made, the guide member 30 can be fixed to the base 10 by means of a wedge 34 driven into a groove 33 provided axially in the slide bar 31. This serves to save the trouble of drawing a line along which to cut off the piece of a thin board.

Figure 4:
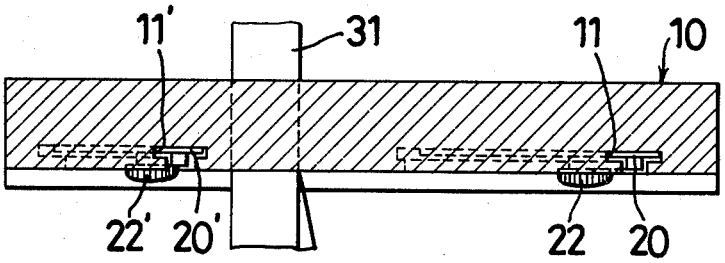
FIG. 4 is a horizontal sectional view of another embodiment of the present invention.

Another embodiment of the present invention shown in FIG. 4 is distinguished from the embodiment shown in FIGS. 1 to 3 by the guide grooves 11, 11' which are directly provided in the base 10, i.e., without the blade mounting members 21, 21' interposed between the base 10 and the guide grooves 11, 11'.

Figure 5:
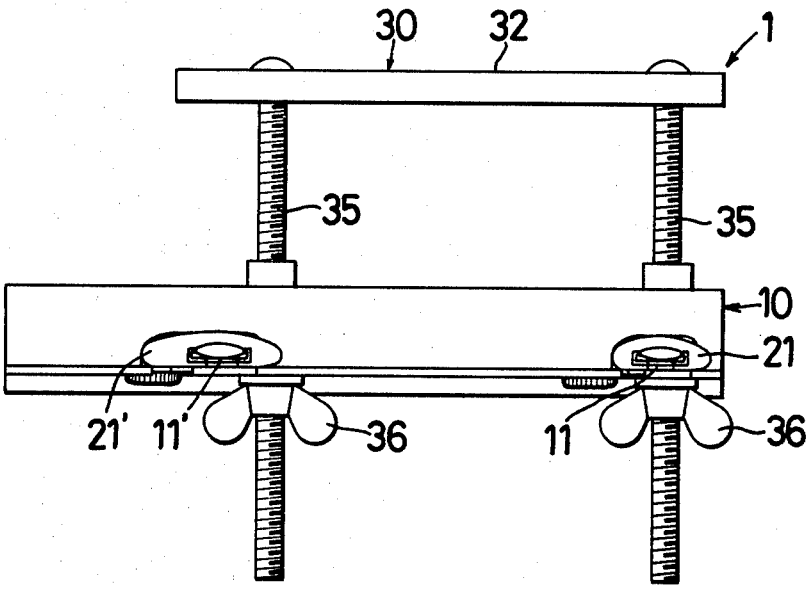
FIG. 5 is a plan view of still another embodiment of the present invention.

Still another embodiment of the present invention shown in FIG. 5 is distinguished from the embodiments shown in FIGS. 1 to 4 by screw-threaded shafts 35 provided in place of the slide bar 31. In this case, the distance between the guide plate 32 and the cutting blades 20, 20' is adjusted by means of wing nuts 36 rotatably mounted on the base 10 and fitting on the screw-threaded shafts 35.

The distance between the guide plate 32 and the cutting blades 20, 20' may be adjusted by means of racks and worm gears. The screw-threaded shafts 35 or the rackwork dispenses with the groove 33 and the wedge 34.

An occasion demands, the cutter in accordance with the present invention may be provided with more than two cutting blades.

Figure 6:
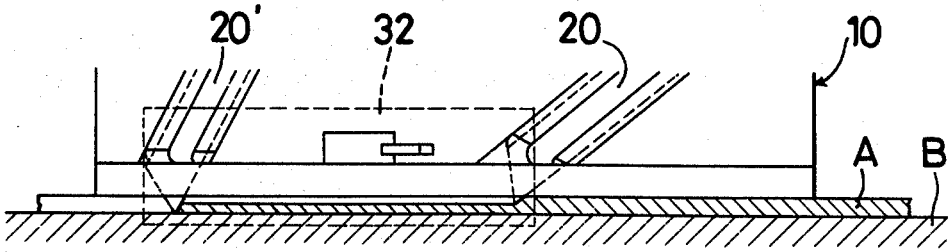
FIG. 6 is a diagram of assistance in explaining the operation of the invention.

Referring now to FIG. 6, a thin board A is fixed on the upper surface of a bench B. The edges of the cutting blades 20, 20' are projected downward from the slits 14, 14' to such an extent that the length of each projecting part is suited to the thickness of the thin board A, namely, the length of the projecting part of the cutting blade 20 is made smaller than the thickness of the thin board A, while the length of the projecting part of the cutting blade 20' is made slightly larger than the thickness of the thin board A. The distance between the guide plate 32 and the cutting blades 20, 20' is adjusted to the breadth of a piece of the thin board A to be cut off, and the guide member 30 is fixed to the base 10 by means of the wedge 34 in case of the first and second embodiments of the present invention. The inside of the guide plate 32, i.e., the side of the guide plate 32 fronting on the base 10, is placed against an edge of the thin board A which runs parallel to the line along which to cut off the piece. The cutter 1 is moved from left to right in FIG. 6, with the under surface of the bottom plate 13 and the inside of the guide plate 32 pressed against the upper surface and the edge of the thin board A respectively. The first shallow cut, which is made with the cutting blade 20 at a smaller angle, is traced by the cutting blade 20' at a larger angle so that the severance may be effected by the latter.

Because of a plurality of cutting blades arranged so as to form progressively larger angles with the under surface of the bottom plate 13, the cutter in accordance with the present invention requires only little physical strength and yet a single cutting stroke is enough to cut off a piece. The cut ends need not be finished, because they are free from ruggedness. The guide membre 30 dispenses with other means by which the edges of the cutting blades are to be guided during the cutting stroke. Thin boards can be cut with accuracy without the necessity of drawing a line along which to cut off each piece. There is no likelihood of the cutter in accordance with the present invention inflicting an injury on the operator.

While I have disclosed several embodiments of the present invention, it is to be understood that they have been given by way of example only and not in a limiting sense, the scope of the present invention being determined by the object and the claims.

What I claim is:

1. A cutter for cutting thin boards comprising a base having an even under surface and provided with a plurality of guide grooves on one side in such a manner that they are arranged so as to form progressively larger angles with said under surface, a plurality of cutting blades mounted in said guide grooves in such a manner that they fall on the same plane with each other, and a guide member adjustably provided in the lower part of said base.

2. The cutter as set forth in claim 1, wherein said guide member comprises a slide bar slidably inserted in a hole provided crossways in said base, a guide plate provided at an end of said slide bar, and a means for fixing said guide member in place.

3. The cutter as set forth in claim 1, wherein said guide member comprises screw-threaded shafts, a guide plate provided at an end of said screw-threaded shafts, and wing nuts rotatably mounted on said base and fitting on said screw-threaded shafts.

* * * * *